US007551884B2

(12) United States Patent
Watanabe et al.

(10) Patent No.: US 7,551,884 B2
(45) Date of Patent: Jun. 23, 2009

(54) CLEANING APPARATUS AND IMAGE FORMING APPARATUS

(75) Inventors: Takeshi Watanabe, Yokohama (JP); Masashi Takahashi, Yokohama (JP); Mitsuaki Kouyama, Higashikurume (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 420 days.

(21) Appl. No.: 11/448,342

(22) Filed: Jun. 7, 2006

(65) Prior Publication Data

US 2007/0286653 A1 Dec. 13, 2007

(51) Int. Cl.
*G03G 21/00* (2006.01)

(52) U.S. Cl. ..... 399/350

(58) Field of Classification Search ..... 399/350, 399/343

See application file for complete search history.

(56) References Cited

U.S. PATENT DOCUMENTS

2005/0141923 A1* 6/2005 Ota ..... 399/350
2006/0112512 A1* 6/2006 McNeil
2007/0274738 A1* 11/2007 Watanabe et al.

FOREIGN PATENT DOCUMENTS

| | | | |
|---|---|---|---|
| JP | 63008783 | A * | 1/1988 |
| JP | 02216178 | | 8/1990 |
| JP | H02-216178 | | 8/1990 |
| JP | 04311988 | A * | 11/1992 |
| JP | H05-19671 | | 1/1993 |
| JP | 05027551 | A * | 2/1993 |
| JP | 11038848 | A * | 2/1999 |
| JP | 2002-132016 | | 5/2002 |
| JP | 2002-278219 | | 9/2002 |
| JP | 2004-191708 | | 7/2004 |
| JP | 2005062475 | | 3/2005 |
| JP | 2005-88767 | | 4/2005 |
| JP | 2005202133 | | 7/2005 |
| JP | 2005202133 | A * | 7/2005 |

OTHER PUBLICATIONS

Qian, et al "The Development of Organic Photo Conductors", 2001, vol. 2, No. 2.

* cited by examiner

*Primary Examiner*—Susan S Lee
(74) *Attorney, Agent, or Firm*—Turocy & Watson, LLP

(57) ABSTRACT

The cleaning apparatus according to the invention is concerned with a cleaning apparatus provided with a cleaning blade which removes a developer remaining on the surface of an image carrier, which is characterized in that the cleaning blade is made of a resinous matrix in which at least one of a fullerene and a carbon nano tube is dispersed. In accordance with the cleaning apparatus according to the invention, it is possible to make high durability and good cleaning performance compatible with each other.

20 Claims, 9 Drawing Sheets

Test results of carbon nano tube-dispersed blade

| Test No. | | Dispersion amount (%) | Hardness (°) | Edge angle (°) | Initial cleaning properties | Ordinary-temperature and ordinary-humidity circumstance: ⇒ Continuous printing: State of image and blade | At the time of printing on 10,000 sheets: Shaving amount (μm) | At the time of printing on 10,000 sheets: Surface roughness (μm) | High-temperature and high-humidity circumstance: ⇒ Continuous printing: State of image and blade | At the time of printing on 20,000 sheets: Shaving amount (μm) | At the time of printing on 20,000 sheets: Surface roughness (μm) | ⇒ 25,000 sheets: State of image and blade | Low-temperature and low-humidity circumstance: 25,000 sheets ⇒: State of image and blade | At the time of printing on 30,000 sheets: Shaving amount (μm) | At the time of printing on 30,000 sheets: Surface roughness (μm) | High-temperature and high-humidity circumstance: ⇒ 31,000 sheets: State of image and blade | Low-temperature and low-humidity circumstance: ⇒ 35,000 sheets: State of image and blade | 35,000 sheets ⇒: State of image and blade | At the time of printing on 40,000 sheets: State of image and blade | Overall evaluation |
|---|---|---|---|---|---|---|---|---|---|---|---|---|---|---|---|---|---|---|---|---|
| 1 | Comparison | 0 | 60 | 90 | A | | 0.7 | 4 | | 1.5 | 4.5 | | | 2.3 | 4.7 | | CL failure, F | | | B |
| 2 | | | 60 | | B | | 1.0 | 4.0 | | 1.9 | 4.4 | CL failure, F | | | | | | | | D |
| 3 | | | 70 | | A | CL failure | | | | | | | | | | | | | | DD |
| 4 | | | 90 | | A | CL failure | | | | | | | | | | | | | | DD |
| 5 | | | 60 | 80 | B | | 0.5 | 3.3 | Turned up | | | | | | | | | | | D |
| 6 | | | 60 | 100 | B | | 1.5 | 4.4 | | 3.1 | 4.7 | CL failure, F | | | | | | | | D |
| 7 | Comparison | 20 Coated in edge part | 60 | 80 | A | | 1.0 | 2.0 | | 2.1 | 2.2 | | | 3 | 2.3 | Turned up | | | | B |
| 8 | | | 60 | 88 | A | | 1.2 | 2.7 | | 2.2 | 2.9 | | | 3.5 | 2.9 | Turned up | | | | B |
| 9 | Comparison | | 60 | 92 | A | | 1.4 | 3.7 | | 2.8 | 4.0 | CL failure, F | | | | | | | | D |
| 10 | Example | 0.02 | 60 | 80 | A | | 0.7 | 2.3 | | 1.7 | 2.5 | | | 2.5 | | | | | OK | A |
| 11 | | | 60 | 90 | A | | 1.1 | 3.2 | | 2.0 | 3.4 | | | 3.1 | 3.6 | | | CL failure, F | | B |
| 12 | | | 60 | 100 | A | | 1.5 | 4.0 | | 3.0 | 4.1 | | CL failure, F | 4.7 | | | | | | C |
| 13 | | 20 | 70 | 50 | A | | 1.1 | 1.6 | | 2.2 | 1.6 | | | 3.3 | 1.7 | | | | OK | A |
| 14 | | | 70 | 70 | A | | 0.9 | 1.9 | | 2.0 | 1.8 | | | 3 | 1.9 | | | | OK | A |
| 15 | | | 70 | 80 | A | | 0.9 | 1.9 | | 2.0 | 2.0 | | | 3 | 2.1 | | | | OK | A |
| 16 | | | 70 | 85 | A | | 1.0 | 2.5 | | 2.1 | 2.5 | | | 3 | 2.7 | | | CL failure, F | | B |
| 17 | | | 70 | 90 | A | | 1.1 | 3.0 | | 2.2 | 3.0 | | | 3.3 | 3.1 | | | CL failure, F | | B |
| 18 | | | 70 | 100 | A | | 1.5 | 3.8 | | 3.0 | 3.9 | | CL failure, F | 4.5 | 4 | | | | | C |
| 19 | | | 70 | 110 | A | | 2.0 | 4.1 | | 4.1 | 4.2 | | CL failure, F | 6 | 4.5 | | | | | C |
| 20 | | 30 | 90 | 80 | A | | 1.1 | 3.0 | | 2.3 | 3.2 | | CL failure | | | | | | | C |
| 21 | | | 90 | 90 | A | | 1.3 | 3.0 | | 2.6 | 3.3 | | CL failure | | | | | | | C |
| 22 | | | 90 | 100 | A | | 1.8 | 4.0 | | 3.6 | 4.0 | | CL failure | | | | | | | C |

Turned up: NG because turning-up of blade occurred.
CL failure: NG because cleaning failure occurred.
CL failure, F: Partial filming was formed, and following this, cleaning failure occurred.

A: Good
B: Moderate
C: Rather poor
D: Poor
DD: Very poor

FIG. 5

Test results of fullerene-dispersed blade (average cluster size: 50 nm)

| | | | | | | Ordinary-temperature and ordinary-humidity circumstance | | | High-temperature and high-humidity circumstance | | | | Low-temperature and low-humidity circumstance | | | High-temperature and high-humidity circumstance | Low-temperature and low-humidity circumstance | | | |
|---|---|---|---|---|---|---|---|---|---|---|---|---|---|---|---|---|---|---|---|---|
| | | | | | | ⇒ Continuous printing | At the time of printing on 10,000 sheets | | ⇒ Continuous printing | At the time of printing on 20,000 sheets | | ⇒ 25,000 sheets | 25,000 sheets ⇒ | At the time of printing on 30,000 sheets | | ⇒ 31,000 sheets | ⇒ 35,000 sheets | 35,000 sheets ⇒ | At the time of printing on 40,000 sheets | Overall evaluation |
| Test No. | | Dispersion amount (%) | Hardness (°) | Edge angle (°) | Initial cleaning properties | State of image and blade | Shaving amount (μm) | Surface roughness (μm) | State of image and blade | Shaving amount (μm) | Surface roughness (μm) | State of image and blade | | Shaving amount (μm) | Surface roughness (μm) | State of image and blade | | | | |
| 31 | Example | 0.02 | 60 | 80 | A | | 0.5 | 2.1 | | 1.5 | 2.3 | | | 2.3 | | | | | OK | A |
| 32 | | | 60 | 90 | A | | 1.0 | 2.9 | | 1.8 | 3.1 | | | 2.8 | | | | CL failure, F | | B |
| 33 | | | 60 | 100 | A | | 1.4 | 3.6 | | 2.7 | 3.7 | | | 4.2 | | | CL failure, F | | | B |
| 34 | | 20 | 68 | 70 | A | | 0.9 | 1.8 | | 1.9 | 1.7 | | | 2.9 | 1.8 | | | | OK | A |
| 35 | | | 68 | 80 | A | | 0.9 | 1.8 | | 1.9 | 1.9 | | | 2.9 | 2.0 | | | | OK | A |
| 36 | | | 68 | 85 | A | | 1.0 | 2.4 | | 2.0 | 2.4 | | | 2.9 | 2.6 | | | CL failure, F | | B |
| 37 | | | 68 | 90 | A | | 1.0 | 2.9 | | 2.1 | 2.7 | | | 3.1 | 2.8 | | | CL failure, F | | B |
| 38 | | | 68 | 100 | A | | 1.4 | 3.6 | | 2.9 | 3.5 | | | 4.4 | 3.6 | | CL failure, F | | | B |
| 39 | | 30 | 88 | 80 | A | | 1.0 | 2.7 | | 2.2 | 3.2 | | CL failure | | | | | | | C |
| 40 | | | 88 | 90 | A | | 1.2 | 2.7 | | 2.5 | 3.1 | | CL failure | | | | | | | C |
| 41 | | | 88 | 100.0 | A | | 1.7 | 3.8 | | 3.4 | 3.8 | | CL failure | | | | | | | C |

Turned up: NG because turning-up of blade occurred.
CL failure: NG because cleaning failure occurred.
CL failure, F: Partial filming was formed, and following this, cleaning failure occurred.

A: Good
B: Moderate
C: Rather poor
D: Poor
DD: Very poor

FIG. 7

Test results of fullerene-dispersed blade (edge angle: fixed at 80 )

| Test No. | | Dispersion amount (%) | Hardness (°) | Average cluster size (nm) | Initial cleaning properties | Ordinary-temperature and ordinary-humidity circumstance | | | High-temperature and high-humidity circumstance | | | | Low-temperature and low-humidity circumstance | | | High-temperature and high-humidity circumstance | Low-temperature and low-humidity circumstance | | | Overall evaluation |
|---|---|---|---|---|---|---|---|---|---|---|---|---|---|---|---|---|---|---|---|---|
| | | | | | | ⇒ Continuous printing | At the time of printing on 10,000 sheets | | ⇒ Continuous printing | At the time of printing on 20,000 sheets | | ⇒ 25,000 sheets | 25,000 sheets ⇒ | At the time of printing on 30,000 sheets | | ⇒ 31,000 sheets | ⇒ 35,000 sheets | 35,000 sheets ⇒ | At the time of printing on 40,000 sheets | |
| | | | | | | State of image and blade | Shaving amount (μm) | Surface roughness (μm) | State of image and blade | Shaving amount (μm) | Surface roughness (μm) | State of image and blade | | Shaving amount (μm) | Surface roughness (μm) | State of image and blade | | | | |
| 51 | C60 | 20 | 66 | 3 | A | | 0.5 | 3.0 | | 0.8 | 3.4 | | | 1.3 | 4.0 | | CL failure, F | | | B |
| 52 | C60 | 20 | 67 | 5 | A | | 0.8 | 1.5 | | 1.6 | 1.7 | | | 2.3 | 1.7 | | | | OK | A |
| 53 | C60 | 20 | 68 | 20 | A | | 0.8 | 1.7 | | 1.9 | 1.8 | | | 2.9 | 1.9 | | | | OK | A |
| 54 | C60 | 20 | 68 | 100 | A | | 0.9 | 1.8 | | 2.0 | 1.9 | | | 3.0 | 2.0 | | | | OK | A |
| 55 | C60 | 20 | 69 | 300 | A | | 1.0 | 1.9 | | 2.1 | 1.9 | | | 3.2 | 2.0 | | | | OK | A |
| 56 | C60 | 20 | 71 | 500 | A | | 2.0 | 2.5 | | 4.1 | 2.7 | | | 6.5 | 3.5 | | CL failure, F | | | B |
| 57 | C70 | 20 | 68 | 100 | A | | 0.9 | 1.8 | | 1.9 | 1.9 | | | 3.0 | 2.1 | | | | OK | A |

Turned up: NG because turning-up of blade occurred.
CL failure: NG because cleaning failure occurred.
CL failure, F: Partial filming was formed, and following this, cleaning failure occurred.

A: Good
B: Moderate
C: Rather poor
D: Poor
DD: Very poor

FIG. 8

Test results of fullerene-dispersed blade when the material of photoreceptor was changed
(edge angle: 80 , fullerene cluster size: 50 nm)

| | | | | Ordinary-temperature and ordinary-humidity circumstance | | | High-temperature and high-humidity circumstance | | | | Low-temperature and low-humidity circumstance | | | High-temperature and high-humidity circumstance | Low-temperature and low-humidity circumstance | | | Overall evaluation |
|---|---|---|---|---|---|---|---|---|---|---|---|---|---|---|---|---|---|---|
| | | | | ⇒ Continuous printing | At the time of printing on 10,000 sheets | | ⇒ Continuous printing | At the time of printing on 20,000 sheets | | ⇒ 25,000 sheets | 25,000 sheets ⇒ | At the time of printing on 30,000 sheets | | ⇒ 31,000 sheets | ⇒ 35,000 sheets | 35,000 sheets ⇒ | At the time of printing on 40,000 sheets | |
| Test No. | | Photoreceptor | Initial cleaning properties | State of image and blade | Shaving amount (μm) | Surface roughness (μm) | State of image and blade | Shaving amount (μm) | Surface roughness (μm) | State of image and blade | | Shaving amount (μm) | Surface roughness (μm) | State of image and blade | | | | |
| 61 | | OPC | A | | 0.8 | 1.7 | | 2.0 | 1.8 | | | 3.8 | 1.9 | | | | OK | A |
| 62 | Coated in edge part | α-Si | A | | 0.2 | 0.3 | Turned up | | | | | | | | | | | D |
| 63 | | | A | | 0.2 | 0.3 | | 0.3 | 0.3 | | | 0.3 | 0.4 | | | | OK | A |
| 64 | | Hardened photoreceptor | A | | 0.3 | 0.2 | | 0.6 | 0.3 | | | 1.0 | 0.4 | | | | OK | A |

Turned up: NG because turning-up of blade occurred.
CL failure: NG because cleaning failure occurred.
CL failure, F: Partial filming was formed, and following this, cleaning failure occurred.

A: Good
B: Moderate
C: Rather poor
D: Poor
DD: Very poor

FIG. 9

Test results when fullerene-dispersed blade was applied to a conveyor belt
(edge angle: 80 , fullerene cluster size: 50 nm)

| | | | | Ordinary-temperature and ordinary-humidity circumstance | | | High-temperature and high-humidity circumstance | | | | Low-temperature and low-humidity circumstance | | | High-temperature and high-humidity circumstance | Low-temperature and low-humidity circumstance | | | Overall evaluation |
|---|---|---|---|---|---|---|---|---|---|---|---|---|---|---|---|---|---|---|
| | | | | ⇒ Continuous printing | At the time of printing on 10,000 sheets | | ⇒ Continuous printing | At the time of printing on 20,000 sheets | | ⇒ 25,000 sheets | 25,000 sheets ⇒ | At the time of printing on 30,000 sheets | | ⇒ 31,000 sheets | ⇒ 35,000 sheets | 35,000 sheets ⇒ | At the time of printing on 40,000 sheets | |
| Test No. | | Belt | Initial cleaning properties | State of belt | Shaving amount (μm) | Surface roughness (μm) | State of belt | | | State of belt | | | | State of belt | | | | |
| 71 | Comparison (no fullerene) | Polyimide | A | | | | Turned up | | | | | | | | | | | D |
| 72 | Coated in edge part | | A | | | | | | | | CL failure | | | | | | | C |
| 73 | Example | | A | | | | | | | | | | | | | | OK | A |

Turned up: NG because turning-up of blade occurred..
CL failure: NG because cleaning failure occurred.
CL failure, F: Partial filming was formed, and following this, cleaning failure occurred.

A: Good
B: Moderate
C: Rather poor
D: Poor
DD: Very poor

FIG. 10

CLEANING APPARATUS AND IMAGE FORMING APPARATUS

BACKGROUND OF THE INVENTION

1. Technical Field of the Invention

The present invention relates to a cleaning apparatus and an image forming apparatus and in particular, to a cleaning apparatus for cleaning a toner remaining on a photoreceptor, a transfer body, or the like and an image forming apparatus provided with that cleaning apparatus.

2. Related Art

A general electrophotographic process is carried out by steps including charging onto a photoreceptor, image exposure, development, transfer from the photoreceptor onto a material to be transferred and cleaning of a residual transfer toner remaining on the photoreceptor after the transfer, and if desired, additionally, destaticization of the photoreceptor.

In the development, when a dry electrophotographic system is concerned, an image is formed on the photoreceptor by a powdered toner, and the image is transferred onto paper or an intermediate transfer medium. On that occasion, a residual transfer toner remaining on the photoreceptor or a toner which has not been transferred from the photoreceptor due to a paper jam or the like is removed from the photoreceptor by a cleaning apparatus. As a toner removing member which is used in the cleaning apparatus, a variety of materials such as a blade, a brush to which a bias has been applied, and a roll are used. In this respect, a blade cleaning system using an elastic blade made of a polyurethane rubber, etc. is comparatively inexpensive and is suited for downsizing.

However, in the case of cleaning the toner which is a fine particle using the blade cleaning system, there are some problems to be solved. For example, when the blade is brought into strong contact with the photoreceptor for the purpose of obtaining a sufficient cleaning performance, an edge of the blade may possibly be broken, or the blade may possibly be turned up. Further, when the blade edge is broken or abraded, the cleaning performance which has been set up at the beginning is not obtained and cleaning failure is generated, whereby serious defects are generated on an image.

Then, there is taken a countermeasure for widening a margin of the cleaning condition by containing a mold release agent such as fluorocarbon resins in a surface portion of the photoreceptor which is a member to be cleaned, thereby improving mold release properties of the photoreceptor, or intermixing a lubricant such as zinc stearate in the toner, thereby reducing the friction between the cleaning blade and the photoreceptor surface and making the toner readily separate from the photoreceptor.

However, what a large amount of the mold release agent is intermixed in a photoreceptor surface material must scarify characteristics of the photoreceptor to some extent so that a high-performance photoreceptor is hardly obtained. Furthermore, what the lubricant is intermixed in the toner influences the charge performance not a little so that a high-performance toner is hardly obtained. Moreover, even when the foregoing countermeasure is taken, it is not always easy to make sufficient cleaning performance and durability compatible with each other.

Then, not only the countermeasure against the photoreceptor or toner but also a countermeasure from a material of the cleaning blade is proposed. For example, JP 2004-191708 A discloses an example in which the tear strength of a contact portion of the cleaning blade with the photoreceptor is enhanced such that the blade edge is not broken.

According to JP 2004-191708 A, it is described that by applying a coating containing a carbon nano tube in the edge portion of the cleaning blade, not only friction resistance in the contact portion with the photoreceptor is brought without affecting the elasticity as a whole of the blade, but also the tear strength of the edge portion is markedly enhanced so that the durability of the blade edge part can be tremendously enhanced. Further, there is disclosed the use of a single wall carbon nano tube containing a fullerene therein as one example of the carbon nano tube.

By using such a blade, the durability of the cleaning blade is certainly enhanced. However, in recent years, in electrophotographic apparatus, it is eagerly required to make the maintenance free or to prolong an interval of the maintenance. In the cleaning blade of the foregoing cited reference, since the coating treatment containing a carbon nano tube is applied in only the edge part, there are encountered problems such that when the blade edge is abraded, the base material layer is immediately exposed and that when in speculating it, thick coating is applied, coating unevenness is generated, or it becomes difficult to keep the precision of the blade edge part.

On the other hand, there is also proposed an approach for enhancing the cleaning performance by adjusting an angle of the edge of the cleaning blade.

For example, JP 2-216178 A disclose a technology in which the angle of the edge of the cleaning blade is reduced from about 90° which is a usual set value and set up at 85 to 90°.

Usually, a toner and others (since there is the case where in the developer, a variety of external additives are contained in the toner, these will be included and referred to as "toner and others" hereinafter) retain in slight amounts in a space which is formed between the edge of the cleaning blade and the photoreceptor surface coming into contact therewith. Filming may possibly be generated due to this retaining toner and others. The filming as referred to herein is a phenomenon in which a sticking layer is formed on the surface of the photoreceptor due to the retaining toner and others. Alternatively, there may be the case where the sticking layer itself is named as filming.

When filming is generated on the photoreceptor surface, the image quality is, as a matter of course, deteriorated. When the retention amount of the toner in the edge part increases, the probability of the generation of filming becomes high, whereas when the retention amount of the toner decreases, the probability of the generation of filming becomes low.

On the other hand, the toner and others retaining in the edge part also work to uniformly polish the photoreceptor surface and make it smooth.

According to the technology as disclosed in JP 2-216178 A, though the opportunity of the generation of filming is certainly reduced by decreasing the retention amount of the toner in the edge part, the work to achieve uniform polishing is also reduced at the same time.

On the other hand, in the case where the angle of the edge part is larger than 90°, the toner and others are liable to retain in the edge part, and an effect for polishing the surface of the member to be cleaned becomes large. For example, JP 5-19671 A discloses an example in which by utilizing this matter, the blade edge is set up at an obtuse angle to increase the retention of the toner and others, thereby polishing the photoreceptor.

This technology intends to make the edge angle of the cleaning blade obtuse, thereby increasing the retention of the toner and to further mix a polishing particle such as titanium oxide in the toner, thereby polishing the photoreceptor. According to this method, though it is certainly possible to shave the photoreceptor, the retention amount of the toner and others increases so that the amount of the toner and others which will become a cause of filming increases, too. Accordingly, under a circumstance in which so-called deposits (filming and the like) increase, a polishing ability for shaving them must be enhanced. That is, one must use these contradictory works sufficiently while balancing and stabilizing them. It is impossible to suppress the filming in a stable manner unless the polishing amount is set up at a considerably increased amount.

In the light of the above, according to the technologies as disclosed in JP 2-216178 A and JP 5-19671 A, the opportunity of the generation of filming is deteriorated if the retention amount of the toner is high; and the polishing action becomes large if the retention amount of the toner is high. Thus, it is difficult to bring a stable polishing action while suppressing the opportunity of the generation of filming.

Now, in electrophotographic apparatus in recent years, for the purpose of achieving a high image quality, it becomes frequent to use a small-sized toner having an average particle of not more than 6 μm or a toner close to a sphere. For that reason, it becomes difficult to keep a good cleaning performance.

Under such a circumstance, not only the durability of the blade cleaning but also the matter on how should the surface state of the side to be cleaned, for example, a photoreceptor and a transfer belt, be kept good becomes important more and more. For example, if the surface to be cleaned is roughly shaved by the toner or its external additives and others retaining on the cleaning blade or in the vicinity of the edge of the cleaning blade, thereby forming irregularities on the photoreceptor surface, or the toner or its external additives are stuck onto the surface, even when the durability of the cleaning blade is enhanced, it is impossible to keep good cleaning performance.

SUMMARY OF THE INVENTION

Under the foregoing background, the invention has been made, and an object thereof is to provide a cleaning apparatus provided with a cleaning blade capable of making high durability and good cleaning performance compatible with each other and an image forming apparatus provided with that cleaning apparatus.

In order to achieve the foregoing object, a cleaning apparatus according to one embodiment of the invention is concerned with a cleaning apparatus provided with a cleaning blade which removes a developer remaining on the surface of an image carrier, wherein the cleaning blade is made of a dispersion of at least one of a fullerene and a carbon nano tube in a resinous matrix.

Also, in order to achieve the foregoing object, an image forming apparatus according to one embodiment of the invention is concerned with an image forming apparatus provided with a photoreceptor, an exposure apparatus which forms an electrostatic latent image on the surface of the photoreceptor, a development apparatus which develops the electrostatic latent image with a developer, and a cleaning blade which removes the developer remaining on the surface of the photoreceptor, wherein the cleaning blade is made of a dispersion of at least one of a fullerene and a carbon nano tube in a resinous matrix.

BRIEF DESCRIPTION OF THE DRAWINGS

In the accompanying drawings,

FIG. 5 is a first table to show the results of an evaluation test of a cleaning apparatus according to an embodiment of the invention;

FIG. 7 is a second table to show the results of an evaluation test of a cleaning apparatus according to an embodiment of the invention;

FIG. 8 is a third table to show the results of an evaluation test of a cleaning apparatus according to an embodiment of the invention;

FIG. 9 is a fourth table to show the results of an evaluation test of a cleaning apparatus according to an embodiment of the invention; and FIG. 10 is a fifth table to show the results of an evaluation test of a cleaning apparatus according to an embodiment of the invention.

DETAILED DESCRIPTION OF THE PREFERRED EMBODIMENTS

Embodiments of a cleaning apparatus and an image forming apparatus according to the invention will be hereunder described with reference to the accompanying drawings.

Figure 1:
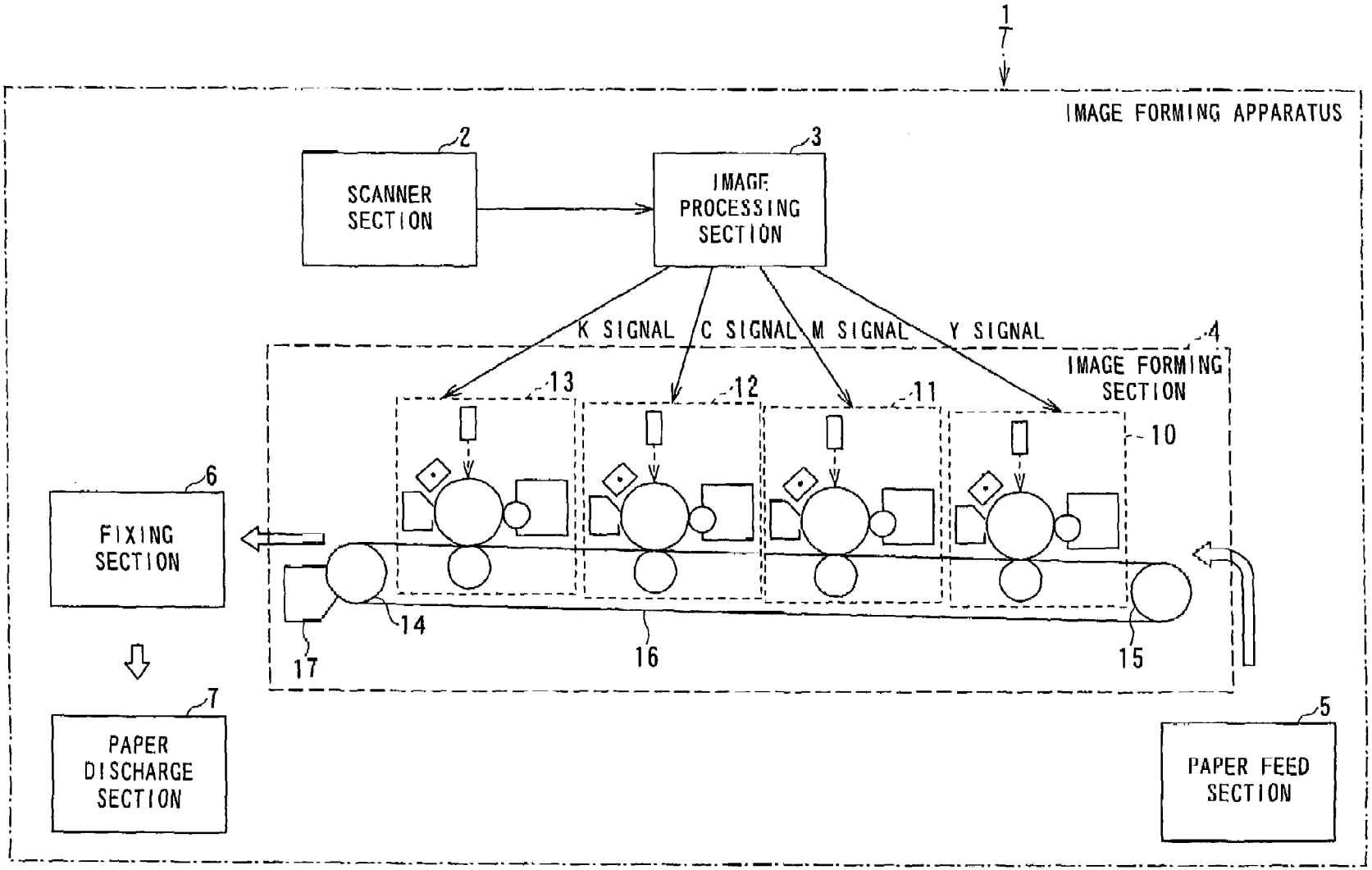
FIG. 1 is a view to show an entire configuration example of an image forming apparatus according to an embodiment of the invention.

(1) Image Forming Apparatus:

FIG. 1 is a view to show a configuration example of an image forming apparatus 1 according to the present embodiment. The image forming apparatus 1 as illustrated in FIG. 1 is, for example, a color tandem type copier.

The image forming apparatus 1 is configured to have a scanner section 2, an image processing section 3, an image forming section 4, a paper feed section 5, a fixing section 6, a paper discharge section 7, and so on.

In the scanner section 2, a color original is read and converted into three primary color image data R, G and B.

In the image processing section 3, the three primary colors are converted by color conversion processing into four print color signals of a Y (yellow) signal, an M (magenta) signal, a C (cyan) signal and a K (black) signal. Besides, in the image processing section 3, a variety of image processings such as filtering processing and half-tone processing are carried out.

The respective image processed Y, M, C and K signals are inputted in the image forming section 4.

The image forming section 4 is provided with four image forming units corresponding to the respective Y, M, C and K colors (an image forming unit 10 for Y, an image forming unit 11 for M, an image forming unit 12 for C, and an image forming unit 13 for K). There are also provided an endless conveyor belt 16 for conveying recording paper, a drive roll 14 for driving the conveyor belt 16, a paper feed roll 15 for following the drive roll and feeding the recording paper onto the conveyor belt, a belt cleaning apparatus 17 for cleaning a toner attached to the drive roll, and others.

The recording paper as fed from the paper feed section 5 is conveyed from the paper feed roll 15 to the vicinity of the drive roll 14 by the conveyor belt 16. Meanwhile, a Y toner image, an M toner image, a C toner image, and a K toner image are successively superposed and transferred on the recording paper.

Thereafter, the toner images are fixed on the recording paper by the fixing section 6 and then discharged out from the paper discharge section 7.

Since the respective image forming units 10, 11, 12 and 13 are different in the toner color but identical in the basic configuration and operation, the detailed configuration and operation will be described below while selecting, as an example, the image forming unit 10 for Y among them.

Figure 2:
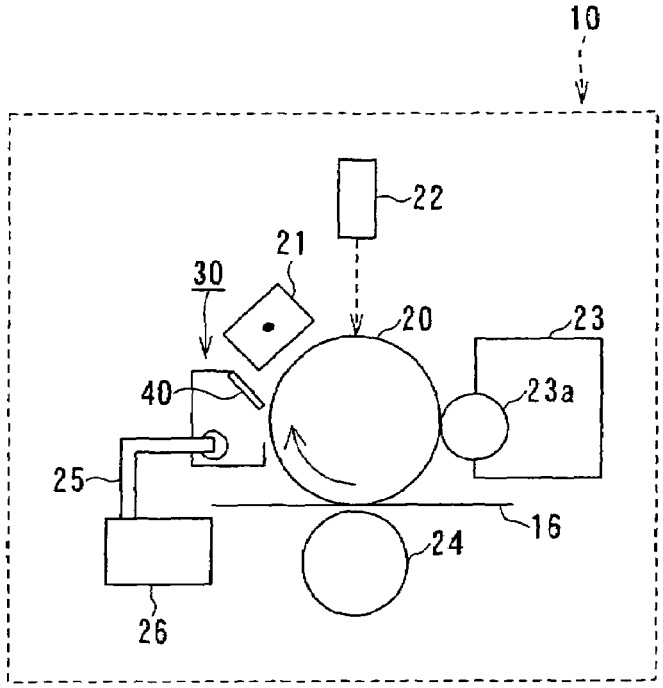
FIG. 2 is a view to show a configuration example of an image forming unit of an image forming apparatus according to an embodiment of the invention.

FIG. 2 is a view to show a detailed configuration example of the image forming unit 10. The image forming unit 10 has a rotatory photoreceptor 20 in the vicinity of the center thereof and is provided with a charging apparatus 21, a laser apparatus 22, a development apparatus 23, and a fixing roll 24 and a cleaning apparatus 30, respectively along the rotation direction.

The photoreceptor 20 is, for example, a photosensitive drum made of an organic photoreceptor having an organic photosensitive layer provided on a conductive substrate. In this case, for example, an organic photosensitive layer having a hole transport material containing a chain polymerizable functional group as disclosed in JP 2005-173566 A may be used as the organic photosensitive layer.

Besides, a form in which a photosensitive layer made of a material containing amorphous silicon is provided on a conductive substrate may be employed.

The charging apparatus 21 is, for example, a scorotron charging apparatus, and the surface of the photoreceptor 20 is, for example, uniformly charged at about −500 V. Besides, known roll charging apparatus and corona charging apparatus may be employed as the charging apparatus 21.

The laser apparatus 22 irradiates and exposes the surface of the photoreceptor 20 charged with laser beams which have been modulated by an image signal (in this case, the Y signal). The potential of the photoreceptor 20 after the exposure is about −80 V, and an electrostatic latent image is formed on the surface of the photoreceptor 20.

Next, the electrostatic latent image is developed by the development apparatus 23. In the development apparatus 23, for example, a two-component developer made of a mixture of a non-magnetic toner which is charged in negative polarity (in this case, the Y toner) and a magnetic carrier is included therein. By forming a nap by a carrier on a development roll 23*a* provided with a magnet and applying a negative potential of from about −200 to −400 V to the development roll 23*a*, the toner attaches only to an exposed area of the surface of the photoreceptor 20, thereby forming the Y toner image on the surface of the photoreceptor 20.

Incidentally, a single-component developer which does not use a carrier may be used in place of the two-component developer.

On the other hand, the recording paper is conveyed by the conveyor belt 16. During the time when the recording paper passes between the photoreceptor 20 and the transfer roll 24 as provided in an opposing position thereto, the Y toner image is transferred from the surface of the photoreceptor 20 onto the recording paper.

Thereafter, an M toner image, a C toner image and a K toner image are similarly superposed and transferred onto the recording paper, and the resulting recording paper is then sent to the fixing section 6.

On the other hand, ever after transferring onto the recording paper, a part of the toner remains on the surface of the photoreceptor 20. This residual toner (residual developer) is cleaned by the cleaning apparatus 30. The cleaning of the toner is carried out by using a cleaning blade 40. The toner which has been scraped by the cleaning blade 40 is sent to a waste toner tank 26 via a waste toner passage 25.

Incidentally, with respect to components which each of the image forming units 10, 11, 12 and 13 possesses, there may be employed a form in which at least each photoreceptor and each development apparatus are accommodated in four process cartridges (corresponding to the image forming units 10, 11, 12 and 13, respectively) which are detachable from the image forming apparatus 1.

Figure 3:
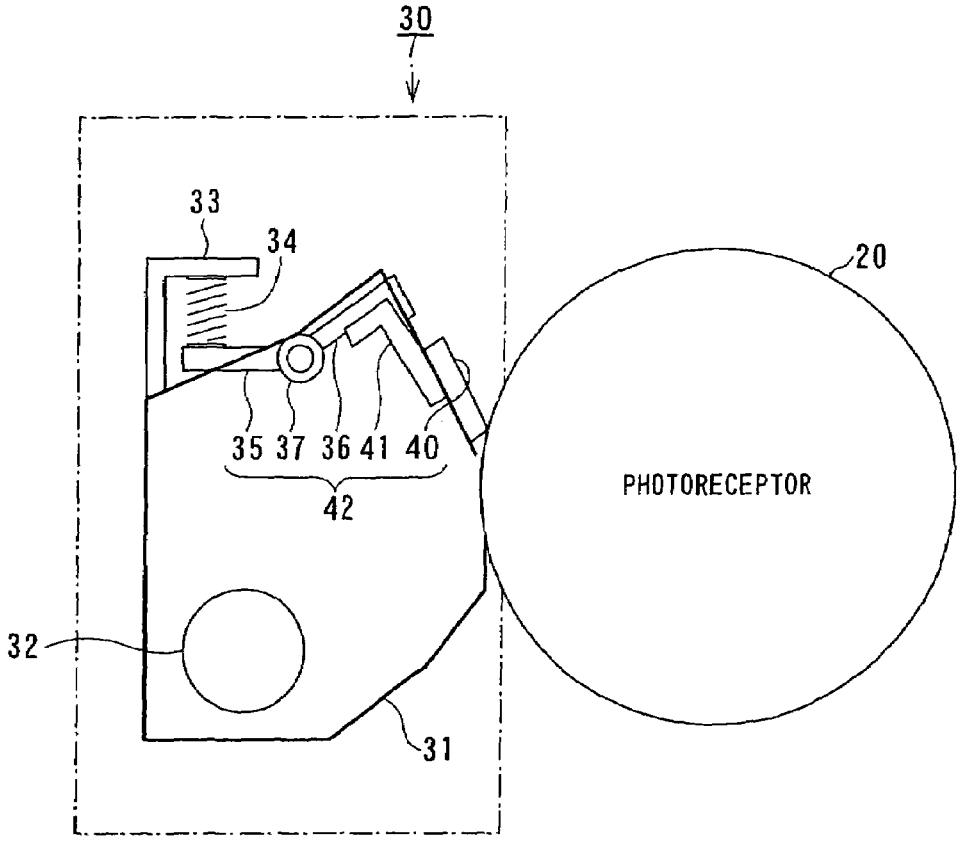
FIG. 3 is a view to shown a configuration example of a cleaning apparatus according to an embodiment of the invention.

(2) Cleaning Apparatus:

FIG. 3 is a cross-sectional view to illustrate the structure of the cleaning apparatus 30 according to the present embodiment. The cleaning apparatus 30 is provided with a casing 31, a spring supporting member 33 which is fixed to the casing 31 and which supports one end of a spring 34, the spring 34, and a blade unit 42.

In the blade unit 42, a supporting member (1) 35 to which the other end of the spring 34 is connected, a rotation axis 37, a supporting member (2) 36, an L-shaped metallic material 41, and a cleaning blade 40 are successively connected and integrally configured.

The blade unit 42 is configured rotatably around the rotation axis 37, and a tip (edge) of the cleaning blade 40 is pressed onto the surface of the photoreceptor 20 by a tensile force of the spring 34.

The cleaning blade 40 is installed against the rotation of the photoreceptor 20, and by pressing the edge of the cleaning blade 40 onto the surface of the photoreceptor 20, the residual toner is scraped off from the surface of the photoreceptor 20.

The scraped toner (waste toner) remains inside the casing 31 and is conveyed to the waster toner tank 26 by a conveyance measure such as an auger 32.

A point of the invention resides in the material and composition and others of the cleaning blade 40 and the shape (edge angle) of the edge part of the cleaning blade 40. By devising them, high durability and high cleaning performance are realized at the same time.

The material and composition and others of the cleaning blade 40 and the shape (edge angle) of the edge part of the cleaning blade 40 according to the present embodiment will be hereunder described.

Figures 4A, 4B:
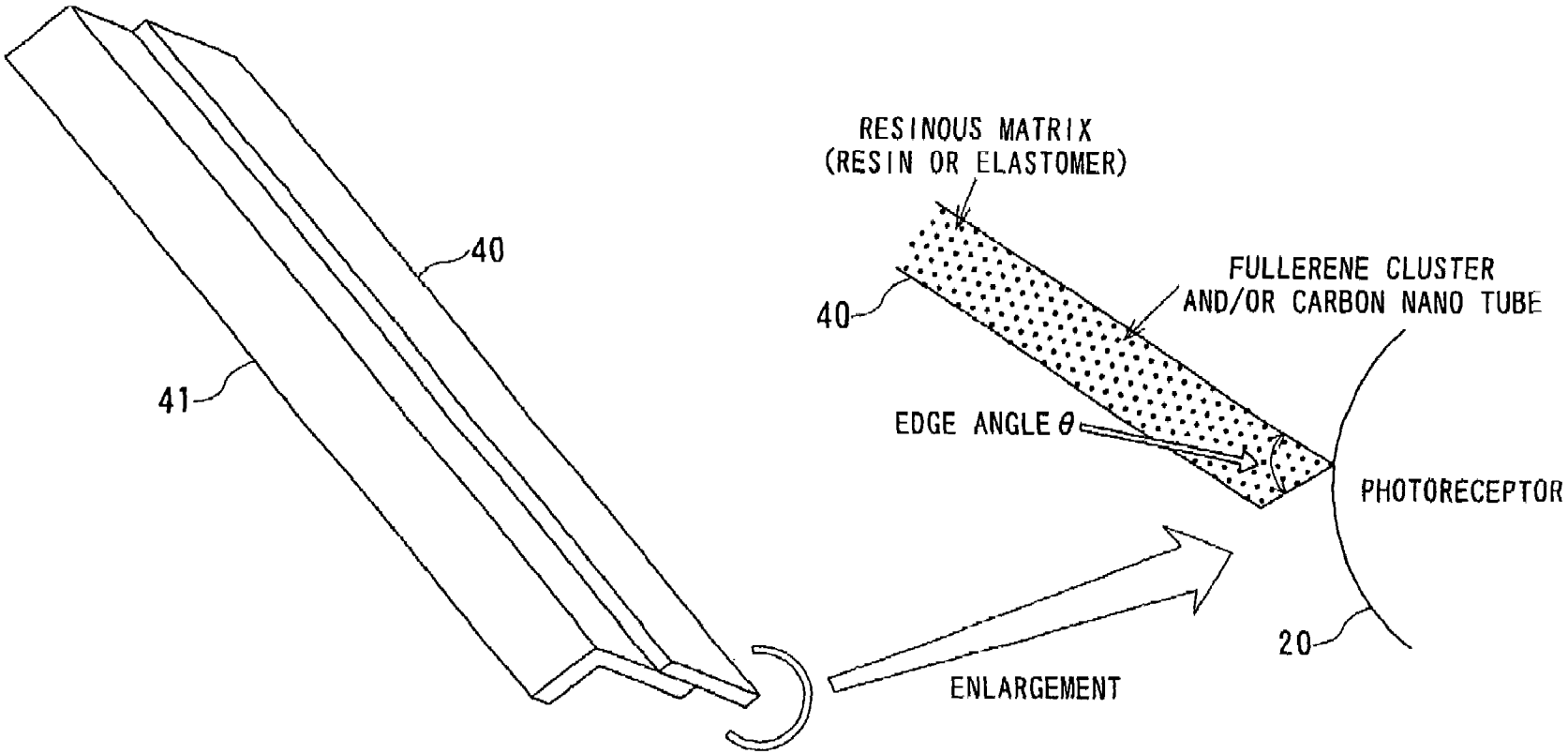
FIG. 4A and FIG. 4B are each a view to schematically show a characteristic feature of a cleaning blade according to an embodiment of the invention.

FIG. 4A is an oblique view to take out and illustrate the cleaning blade 40 and the L-shaped metallic material 41 supports the cleaning blade 40 in the cleaning apparatus 30. Furthermore, FIG. 4B is a view to enlarge and schematically show a tip part of the cleaning blade 40.

The material of the base material of the cleaning blade is a resinous matrix made of a resin or an elastomer. Examples of the elastomer include diene based rubbers and hydrogenated substances thereof (for example, epoxized natural rubbers and NBR), acrylic rubbers, hydrin rubbers, silicon rubbers (for example, dimethyl silicon rubbers and methyl vinyl silicon rubbers), polyurethane rubbers, acrylonitrile rubbers, and styrene based rubbers. These materials can be used singly or as a mixture containing arbitrary materials.

In the base material, at least one of a carbon nano tube (for example, carbon nano tubes and carbon nano wires) and a fullerene is dispersed. Of these, carbon nano tubes or carbon nano wires have a special fine structure. In particular, the carbon nano tube is a fibrous substance having a hollow structure in which graphene sheets are stuck in a concentric circle state and an external shape thereof has a diameter of from 0.4 to 100 nm.

In general, a fine carbon fiber represented by a carbon nano tube is produced in a structure in which fine fibers are intertwined, and it is difficult to knead this with an elastomer. With respect to the uniform dispersion of such a fine carbon fiber, its dissolution method is proposed in JP 2005-88767 A. JP 2005-88767 A discloses a technology regarding a forming method of a wiper blade, and in the present embodiment, it is also possible to prepare an elastomer having relatively good dispersibility of a fine carbon particle by employing this proposed dispersion method. In the present embodiment, though the shape of the cleaning blade 40 is ultimately molded, it can be prepared by properly utilizing centrifugal molding, extrusion molding, shape molding, and the like as its molding method.

As described previously, the cleaning blade 40 according to the present embodiment is a dispersion of a fine carbon particle represented by a carbon nano tube or a fullerene in an elastomer containing, as the major component, a polyurethane rubber or a silicon rubber.

As the carbon nano tube, known materials can be used, and those having a diameter of from 1 nm to 500 nm and a length having from 10 nm to 500 μm can be used. With respect to the fullerene, though ones having a particle size of from 1 nm to 1 μm can be used, those having a particle size in the range of from 5 nm to 300 nm are preferable for the purpose of effectively exhibiting a polishing action as described later.

With respect to the total amount of the fullerene or carbon nano tube, ones in which the fullerene or carbon nano tube is dispersed in an amount of from 0.02 to 20 parts by weight based on 100 parts by weight of the resin or elastomer can be used. However, in particular, for the purpose of imparting conductivity to the cleaning blade 40 to destaticize the photoreceptor surface, it is preferable that the fullerene or carbon nano tube is dispersed in an amount of from 10 parts by weight to 20 parts by weight.

In the present embodiment, by dispersing a carbon nano tube or a fullerene in not only the edge part of the cleaning blade 40 but also the whole of the member of the cleaning blade 40 including the edge part, the hardness of the cleaning blade 40 is increased.

Hitherto, in the case where the hardness of the cleaning blade 40 is insufficient, there had sometimes occurred a phenomenon in which the cleaning blade 40 is turned up in the rotation direction of the photoreceptor 20 (hereinafter simply referred to as "turning-up"). When the "turning-up" occurs, not only the cleaning performance is remarkably lowered, but also it does not spontaneously return to the original state. Thus, the "turning-up" becomes a serious problem for the image forming apparatus 1.

In the present embodiment, since the hardness of the cleaning blade 40 can be increased, it is possible to prevent the generation of this "turning-up".

Furthermore, as illustrated in FIG. 4B, by dispersing the carbon nano tube or fullerene in not only the edge part of the cleaning blade 40 but also the whole of the member of the cleaning blade 40 including the edge part, even when the edge part is abraded, good cleaning performance can be kept over a long period of time.

Next, the edge angle will be described. In the cleaning blade 40 according to the present embodiment, the edge part of the cleaning blade 40 is formed such that an edge angle θ is generally an acute angle of not more than 90° in a state that the cleaning blade 40 comes into contact with the photoreceptor 20.

As a result, the retention of the toner in the vicinity of the edge part can be reduced, and the opportunity of the generation of filming can be reduced. Furthermore, by imparting a stable polishing action to the blade itself by a blade having a carbon nano tube or a fullerene dispersed therein, the filming is prevented from occurring without unnecessarily shaving a member to be cleaned.

As described previously, JP 2-216178 A discloses a technology for setting up the edge angle at an acute angle of from 85° to 90°. However, when the edge angle is merely set up at an acute angle, in the case where the hardness of the cleaning blade is insufficient, the "turning-up" is liable to occur. Furthermore, when the edge angle is set up at an acute angle, though the opportunity of the generation of filming is reduced, a polishing effect due to the toner and others retaining in the edge part is reduced so that the cleaning performance is not always enhanced.

On the other hand, in the cleaning blade 40 according to the present embodiment, by setting up the edge angle at an acute angle, there are brought not only an effect for reducing the retention of the toner and others and suppressing the generation of filming but also an effect for enhancing the cleaning performance.

That is, by setting up the edge angle of the cleaning blade 40 at an acute angle, the deformation amount of the edge part increases as compared with the case where the edge angle is an obtuse angle. Microscopically, it is thought that the cleaning effect due to the cleaning blade 40 is attained by a minute vibration phenomenon in which the edge is deformed in a portion coming into contact with the surface of the photoreceptor 20 and when rubbed with the surface of the photoreceptor 20, is pulled to return to the original state. As in the present embodiment, since when the edge angle becomes an acute angle, its deformation amount increases, the vibration vigorously occurs, whereby a stress which is applied to the edge part increases, but the polishing effect increases.

It is thought that this is caused by the polishing action of the blade itself and a mutual action between the toner or external additives thereof as mediated extremely close to the deformed edge portion and the edge part, and a very stable uniform polishing effect is attained. Though this effect for uniformly polishing the surface of the member to be cleaned is obtained so far as the blade edge is set up at an acute angle, it is desirable that the blade edge is generally set up at not more than 80°.

In a conventional blade in which neither carbon nano tube nor fullerene is dispersed, when the edge angle is set up at an acute angle, since the strength of the blade is low, the "turning-up" of the edge takes place, or as the case may be, a phenomenon in which the edge is broken occurs. However, the cleaning blade 40 according to the present embodiment is high in strength so that it is able to keep a high polishing action over a long period of time.

While the foregoing polishing action is effective by dispersing a carbon nano tube in the cleaning blade 40, a more stable effect is liable to be obtained in the case where a fullerene is dispersed. Here, it is important to appropriately select and adjust the size of a cluster of the fullerene, and a sufficiently stable polishing effect is obtained by regulating the cluster size of the fullerene at from about 5 to 30 nm.

So far, while the cleaning blade 40 of the cleaning apparatus 30 for cleaning up the residual toner of the photoreceptor 20 has been described, it should not be construed that the scope of application of this technology is limited only to the cleaning apparatus 30 of the photoreceptor 20.

For example, this technology is also applicable to the belt cleaning apparatus 17 for cleaning up the conveyor belt 16 (see FIG. 1).

In the image forming apparatus 1 of a transfer belt type as illustrated in FIG. 1, the toner and others do not attach onto the conveyor belt 16 at the time of usual operation. However, the toner may possibly attach onto the conveyor belt 16 due to a trouble such as a paper jam. In this case, the attached toner is cleaned by the belt cleaning apparatus 17.

For this belt cleaning apparatus 17, a form the same as in the foregoing cleaning blade 40 may be employed (a cleaning blade of the belt cleaning apparatus 17 will be hereinafter given the same symbol and named as "cleaning blade 40").

A toner image is not printed on the conveyor belt 16 unless otherwise a paper jam or the like arises. That is, in many cases, the cleaning blade 40 is continuously rubbed in a toner-free state with the conveyor belt 16, and a stress which is applied to the edge part of the cleaning blade 40 becomes large. With the conventional blade, the "turning-up" of the blade is liable to occur, however, with the cleaning blade 40 according to the present embodiment, the "turning-up" does not occur because the whole of the blade has high hardness.

Furthermore, when the surface of the conveyor belt 16 is made of a material which is relatively easily abraded, the belt surface is shaved. However, when the conveyor belt 16 is formed of, for example, a rigid material such as polyimide resins, the blade edge is inversely abraded. In this case, in a blade in which a carbon nano tube is dispersed only in the edge part (for example, a cleaning blade as disclosed in JP 2004-191708 A), when the blade edge is shaved, the base material layer is exposed so that not only the cleaning condition is changed due to the shaving, but also material characteristics are changed. Further, when the base material layer is once exposed, the abrasion of the edge is more accelerated so that when used over a long period of time, cleaning failure is liable to be generated.

On the other hand, in the cleaning blade 40 according to the present embodiment, since a carbon nano tube or a fullerene is dispersed in not only the edge part but also the whole of the blade base material, even when the edge part is abraded, a region in which the carbon nano tube or fullerene is dispersed is always exposed and brought into contact with the conveyor belt 16 so that the abrasion is not accelerated and that a cleaning performance can be kept over a long period of time.

Besides, there is also a form for using an intermediate transfer body such as an intermediate transfer belt and an intermediate transfer drum depending upon the type of the image forming apparatus. In such an intermediate transfer body, a toner image is always intermediately transferred even at the time of usual operation. In this sense, the state of the toner remaining on the surface is analogous to the photoreceptor 20 rather than the conveyor belt 16. A performance required for the cleaning blade for the intermediate transfer body does not largely differ from the performance required for the cleaning blade 40 for the photoreceptor 20, and the cleaning blade 40 according to the present embodiment can also be applied to the cleaning blade for the intermediate transfer body.

In this way, in accordance with the cleaning blade 40 according to the present embodiment, by dispersing a carbon nano tube which is a fine carbon fiber or a fullerene in not only the edge part but also the whole of the blade including the edge part, even when the blade edge is abraded, it is possible to keep its effect over a long period of time.

Furthermore, by setting up the edge angle of the edge part at not more than 90° (desirably not more than 80°), it is possible to reduce the retention amount of the toner and others in the vicinity of the edge part and to suppress the generation of filming due to the retaining toner and others or a non-uniform and unnecessarily deep polishing effect against the member to be cleaned (for example, photoreceptor 20).

Furthermore, as a synergistic effect of setting up the edge part at an acute angle and realizing a high hardness due to dispersion of a fullerene or the like, the minute vibration effect of the edge part increases, and the cleaning performance is enhanced. For this reason, a polishing effect with a uniform and appropriate depth due to the cleaning blade 40 itself (not non-uniform polishing due to the retaining toner) can be realized, and even if filming is generated, the filming itself can be eliminated.

Furthermore, in particular, from the viewpoint of cleaning of a small-particle size toner, the higher the blade hardness, the more enhanced the cleaning properties. However, according to the conventional blades, the blade edge part was often broken or abraded. In the cleaning blade 40 according to the present embodiment, since the blade hardness can be set up at a high level (for example, 70° or more) by dispersing a fullerene or the like, it is possible to realize high cleaning performance even against a small-particle size toner.

(3) Verification Test (1) of Effect—Verification Test of Cleaning Blade Having a Carbon Nano Tube Dispersed Therein:

(a) Test Method:

Using a polyurethane rubber and a carbon nano tube, a cleaning blade was prepared by utilizing a measure as described in JP 2005-88767 A.

Four kinds of cleaning blades having the amount of addition of a carbon nano tube of 0% (comparison), 0.02%, 20% and 30% were prepared.

Also, a cleaning blade coated with a resin having a carbon nano tube dispersed in only an edge part of the blade was prepared based on the procedure described in JP 2004-191708 A. The thickness of coating was about 4 μm.

In addition, the angle of the edge part was properly selected within the range of from 50° to 100°, thereby preparing eighteen kinds of blade samples.

Each of the blades was regulated so as to have a width of 330 mm, a thickness of 1.5 mm and a length of 12 mm; stuck to an L-shaped metallic material via an adhesive as illustrated in FIG. 4A; and brought into contact with the surface of an organic photoreceptor of ϕ30 mm opposing to the photoreceptor at a contact angle of 20° (an angle formed between the upper face of the edge part and the face in the vicinity of the upper side of the contact point of the photoreceptor 20 in FIG. 4B) while applying a load by utilizing a spring such that the contact pressure was 60 g-weight per cm as illustrated in FIG. 4A.

The test was carried out by first printing on A4-size paper in a proportion of about 5% and continuously printing on 100 sheets in an ordinary-temperature and ordinary-humidity circumstance at a temperature of 21° C. and at a humidity of 50%, thereby confirming whether or not good cleaning could be achieved in the initial state.

Thereafter, printing was carried out on 10,000 sheets in total in the same ordinary-temperature and ordinary-humidity circumstance. Then, the average shaving amount of the photo-receptor at that time was measured, and the surface roughness was further measured.

Here, the average shaving amount was calculated by the change of the average coating thickness of the photoreceptor. The coating thickness of the photoreceptor was measured by an eddy-current coating thickness tester. For the measurement, LH300J as manufactured by Kett Electric Laboratory was used. The measurement was carried out in ten positions at random, and its average value was employed as the average coating thickness.

On the other hand, the surface roughness of each of the photoreceptor and a belt as described later was measured by SURFTEST SJ-400 as manufactured by Mitutoyo Corporation. With respect to the photoreceptor, a cylindrical measurement unit was used; when moved 10 mm in a longitudinal direction of the photoreceptor, the ten-point roughness (Rz) was measured in five places; and by cutting each of the upper and lower data, an average value in the remaining three places was employed as the measured value. With respect to the belt, a belt was moved 10 mm in a random direction in a state that it was placed on a flat metal plate; the ten-point roughness (Rz) was measured in five places in the same way; and by cutting each of the upper and lower data, an average value in the remaining three places was employed as the measured value.

Thereafter, by setting up the circumstance under a high-temperature and high-humidity condition at a temperature of 30° C. and at a humidity of 80%, printing was carried out on 10,000 sheets. On that occasion, whether or not a fault occurred on the image or "turning-up" of the cleaning blade was checked. Subsequently, after printing on 20,000 sheets, the average shaving amount and the surface roughness (Rz) of the photoreceptor were again measured.

Therefore, by setting up the circumstance under a low-temperature and low-humidity condition at a temperature of 10° C. and at a humidity of 20%, printing was carried out on up to 30,000 sheets. Also, whether or not a fault occurred on the image or the like was checked. After printing 30,000 sheets, the average shaving amount and the surface roughness (Rz) were measured, too.

Thereafter, paper-passing was carried out by returning the circumstance to the high-temperature and high-humidity circumstance on up to 31,000 sheets.

Finally, by setting up the circumstance under a low-temperature and low-humidity condition, the printing test was carried out on up to 40,000 in total, thereby confirming whether or not any problem occurred.

(b) Test Results:

A summary of the test results is shown in a table of FIG. 5.

(i) Test Nos. 1 to 6 (Comparison: Not Having a Carbon Nano Tube Dispersed Therein):

In Test No. 1, the test was carried out by using a toner having a relatively large particle size as the comparison. Incidentally, in all of Test Nos. 2, et seq., a toner having a slightly smaller particle size than that of Test No. 1 and having a shape with a relatively higher degree of sphericity than that of Test No. 1, from which a relatively high image quality is liable to be obtained, was used.

Concretely, in Test No. 1, the test was carried out by using a toner having a volume average particle size of 6.3 μm and having a shape factor of 150 in SF-1 and 140 in SF-2, respectively. Also, in all of Test Nos. 2, et seq., the test was carried out by using a toner having a slightly small particle size as 5.9 μm in terms of a volume average particle size and having a shape factor of 130 in SF-1 and 120 in SF-2, respectively.

Here, the volume average particle size of the toner was measured by using a Coulter counter TAII (manufactured by Beckman Coulter, Inc.) and using ISOTON-II (manufactured by Beckman Coulter, Inc.) as an electrolytic solution. Concretely, with respect to the measurement method of the volume average particle size, first of all, several tens mg of a measurement sample was added to a surfactant as a dispersant, and the mixture was added in the foregoing electrolytic solution and ultrasonically dispersed, followed by achieving the measurement. Thereafter, with respect to the measured particle size distribution, accumulated distribution regarding the volume was drawn from a small-particle size side versus the divided particle size range (channel), and a particle size at which the accumulation reached 50% was defined as the volume average particle size.

Furthermore, the degree of sphericity (values of shape factors SF-1 and SF-2) is a value obtained by sampling at random 100 developer images as enlarged in a magnification of 500 times using FE-SEM (S-800) as manufactured by Hitachi, Ltd. and analyzing the image information by a Nicolet's image analyzer (LUZEX) via an interface, followed by calculation according to the following expressions.

$$(SF\text{-}1\ \text{value})=\{(MXLNG)^2/\text{AREA}\}\times(\pi/4)\times 100 \qquad \text{Expression (1)}$$

$$(SF\text{-}2\ \text{value})=\{(PERI)^2/\text{AREA}\}\times(1/4\pi)\times 100 \qquad \text{Expression (2)}$$

AREA: Projected area of toner

MXLNG: Absolute maximum length

PERI: Peripheral length

The production of the toner was carried out by a pulverization method, and the degree of sphericity was adjusted by a heat treatment. The result obtained by using this toner and carrying out a paper-passing test in a hardness of 60° by a conventional cleaning blade not having been subjected to a dispersion treatment with a carbon nano tube or the like is concerned with Test No. 1.

According to the result of Test No. 1, though the initial cleaning was good and no problem was found at all in printing on up to 30,000 sheets, cleaning failure occurred before reaching up to 35,000 sheets. Further, the observation of the photoreceptor surface revealed the generation of partial filming.

In Test No. 2, the same test was carried out by using a small-particle size toner having a volume average particle size of 5.9 μm and a relatively high degree of sphericity so as to have a shape factor SF-1 of 130 and a shape factor SF-2 of 120.

In comparison of this result with that of Test No. 1, first of all, in cleaning on initial 100 sheets, cleaning failure was already observed to even a slight extent. Furthermore, the shaving amount of the photoreceptor increased to even a slight extent, and ultimately, cleaning failure was generated in a state of reaching up to 25,000 sheets. In this way, when the toner is one having a small particle size and having a high degree of sphericity, the blade cleaning was difficult.

Then, when the test was carried out by setting up the hardness of the blade at 70° and 90°, respectively (Test Nos. 3 and 4), the initial cleaning performance was improved, and cleaning failure was not generated. However, when a continuous printing test was carried out, cleaning failure was generated without reaching 10,000 sheets. At that time, the observation of the edge of the blade revealed the generation of partial "breakage".

In this way, when the small-particle size toner was used, cleaning was difficult by the conventional blade; and when the blade hardness was then increased, the blade edge was liable to cause breakage this time. Thus, it is noted that a countermeasure as in the present embodiment is necessary. Then, in all of the tests after that, comparison and study were carried out by using a spherical toner having a particle size of 5.9 μm.

A conventional blade of Test No. 5 not having a carbon nano tube dispersed therein, when the edge angle was set up at 80°, after 10,000 sheets, the blade was turned up shortly after starting the test in the high-temperature and high-humidity circumstance. After 10,000 sheets, the photoreceptor had a shaving amount of 0.5 μm and a surface toughness of 3.3 μm.

In the case of setting up the edge angle at 90° (Test No. 2) and 100° (Test No, 6), though turning-up of the blade was not generated, after 20,000 sheets, cleaning failure was generated shortly after starting continuous printing in the low-temperature and low-humidity circumstance. Furthermore, at that time, the observation of the photoreceptor revealed the generation of filming of the photoreceptor in places.

At this time, the shaving amount of the photoreceptor in printing on 10,000 sheets was 1.0 to 1.5 μm and increased as compared with that when the edge angle was 80°. Furthermore, the surface roughness was 4.0 to 4.4 μm. That is, it is noted that when the edge angle is set up at an acute angle, though the retention amount of the toner in the vicinity of the edge part decreases and the average shaving amount of the photoreceptor decreases, since the surface roughness is in a rough state, not only the polishing action is not stable, but also turning-up of the blade is liable to be generated, whereas when the edge angle is increased, the shaving amount of the photoreceptor increases, the surface roughness increases, and cleaning failure or filming is liable to be generated. Furthermore, even when the edge angle is set up at an acute angle, in the conventional blade, it is noted that the small-particle size toner cannot be completely cleaned from the initial state.

(ii) Test Nos. 7, 8 and 9 (Having a Carbon Nano Tube Dispersed in Only an Edge Part):

In Test Nos. 7, 8 and 9, the test was carried out by using a sample in which a resin having a carbon nano tube dispersed therein was coated only in an edge part of a cleaning blade.

In a sample of Test No. 7 having a blade edge angle of 80°, it is noted that though the shaving amount of the photoreceptor was slightly larger than that of the comparison not having a carbon nano tube dispersed therein, the surface roughness after printing on 10,000 sheets is about 2.0 μm, and the photoreceptor can be shaved very uniformly as compared with the blade not having a carbon nano tube dispersed therein. Further, even after completion of printing on 30,000 sheets in the low-temperature and low-humidity circumstance, a problem was not generated on the image. However, turning-up of the blade was generated shortly after entering the high-temperature and high humidity circumstance. Furthermore, when the blade edge angle was set up at 88°, though the shaving amount slightly increased and the surface roughness increased, a problem was not generated in printing on up to 30,000 sheets. When the blade edge angle was set up at 92°, as compared with the sample having a blade edge angle of 88°, both the shaving amount and the surface roughness increased, and cleaning failure was generated shortly after entering the low-temperature and low-humidity circumstance exceeding 20,000 sheets. At this time, the observation of the blade edge revealed the state that the blade edge was abraded and that the blade base material was exposed.

When the angle of the blade edge increases, though the shaving amount of the photoreceptor increases due to the toner or its external additives and others, it is thought that the amount of abrasion of the blade edge increases at the same time so that the base material of the blade is exposed.

(Incidentally, the blade hardness of each of Test Nos. 4, 5 and 6 as shown in the table is one regarding the whole of the blade but not one regarding the edge part so that the hardness cannot be discussed.)

(iii) Test Nos. 10 to 19 (Having a Carbon Nano Tube Dispersed Entirely Therein, Amount of Dispersion: 0.02 or 20%):

In the samples in which a carbon nano tube is uniformly dispersed entirely over the blade, it is noted that in both a sample having the amount of dispersion of 0.02% and a sample having the amount of dispersion of 20%, when the blade edge angle is not more than 80°, not only the shaving amount of the photoreceptor is small, but also the surface roughness is low and stable. In all of these samples, even after printing on 40,000 sheets, a problem was not generated on the image.

Figure 6:
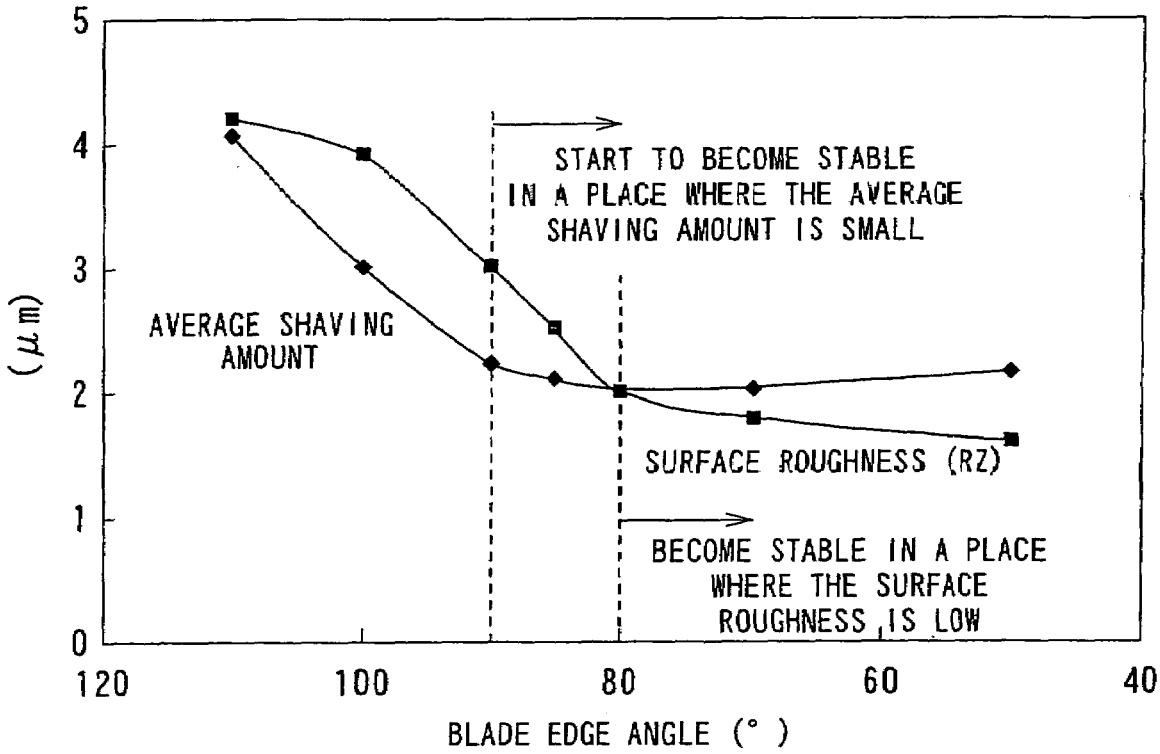
FIG. 6 is a graph to show the test results regarding the relation of an edge angle of a cleaning blade with an average shaving amount of a photoreceptor and the relation thereof with a surface roughness.

The graph of FIG. 6 shows the shaving amount and the surface roughness (Rz) value of the photoreceptor at the time of completion of printing on 20,000 sheets when the amount of addition of a carbon nano tube is 20% and the blade edge angle is varied.

According to FIG. 6, the lower the blade edge angle, the lower the surface roughness, whereby the photoreceptor can be uniformly shaved. In particular, when the edge angle is not more than 80°, the surface roughness is substantially stably in a low state.

Furthermore, with respect to the average shaving amount of the photoreceptor, it is noted that in the case where the blade edge angle is up to about 80°, when the angle is small, the shaving amount can be made low; and that when the edge angle is generally not more than 90°, an inclination of the shaving amount against the angle becomes substantially zero, whereby the shaving amount starts to become stable. While the shaving amount is substantially stable at the edge angle of from 90° to 80°, when the edge angle is made smaller, the shaving amount tends to inversely somewhat increase.

With respect to this phenomenon, by containing a carbon nano tube and further setting up the blade edge at an acute angle, the effect for polishing the photoreceptor becomes larger. On the other hand, when the edge angle is less than 80°, the amount of the retaining toner or external additives in the edge part is substantially zero, and even by setting up the angle at an acuter angler, the polishing effect of the photoreceptor due to the toner or external additives does not change. That is, it is thought that the details of the cause for obtaining the polishing effect do not rely upon the retention of the toner and others but substantially rely upon the blade itself.

Furthermore, in the case where the edge angle is 90°, though the shaving amount and the surface roughness increase as compared with the case where the edge angle is 80°, even after printing on 35,000 sheets, a problem was not generated on the image. However, such did not endure up to 40,000 sheets, and cleaning failure and filming were generated.

In the case where the blade edge angle is 100°, both the shaving amount and the surface roughness further increase. However, in comparison with the comparison not having a carbon nano tube dispersed therein, a long life was attained, and cleaning failure and filming were generated after printing on 25,000 sheets, et seq.

(iv) Test Nos. 20 to 22 (Having a Carbon Nano Tube Dispersed Entirely Therein, Amount of Dispersion: 30%):

In the blade having an amount of dispersion of a carbon nano tube of 30%, the shaving amount of the photoreceptor was liable to increase as a whole, and even by setting up the edge angle at 80°, cleaning failure was generated after printing on 25,000 sheets, et seq. However, likewise the foregoing case, in comparison with the comparison not having a carbon nano tube dispersed therein, a long life was attained, and nevertheless the hardness was 90°, breakage or the like of the blade was not substantially generated. Thus, it is noted that the present embodiment is effective.

In the light of the above, it is noted that by dispersing a carbon nano tube in the blade, the surface roughness can be made small when the photoreceptor is shaved and that there is brought an effect for suppressing the generation of cleaning failure or filming. In addition, by setting up the blade edge angle at an acute angle, it is possible to reduce a shaving effect of the photoreceptor by the toner and to reduce the average shaving amount. Furthermore, while in the type in which a carbon nano tube is dispersed in only the edge part (Test Nos. 7 to 9), turning-up of the blade or cleaning failure was generated due to the long-term use, it is noted that in the present embodiment in which a carbon nano tube is dispersed entirely over the blade (Test Nos. 10 to 22), even by setting up the angle at an acute angle, turning-up of the blade was not generated at all. Furthermore, so far as the blade edge is generally set up at an acute angle of not more than 80°, it is possible to obtain the same stable effect.

With respect to the blade hardness, it is noted that even by making the blade harder than a conventional blade by dispersing a carbon nano tube, breakage or the like of the blade is not generated and that in the Examples, such dispersion explicitly advantageously works to enhance the cleaning performance of a small-particle size toner in a region having a hardness of 70° or more.

In the rightmost column of the table as shown in FIG. 5, the overall evaluation is shown on five grades of "DD" (very poor), "D" (poor), "C" (rather poor), "B" (moderate) and "A" (good). In the paper-passing test, the case where in the first ordinary-temperature and ordinary-humidity circumstance (up to 10,000 sheets), cleaning failure or "turning-up" is generated is designated as "DD" (very poor); the case where in the next high-temperature and high-humidity circumstance (up top 20,000 sheets), cleaning failure or "turning-up" is generated is designated as "D" (poor); the case where in the next low-temperature and low-humidity circumstance (up to 30,000 sheets), cleaning failure or "turning-up" is generated is designated as "C" (rather poor); the case where in the next high-temperature and high-humidity/low-temperature and high-humidity circumstance (up to 40,000 sheets), cleaning failure or "turning-up" is generated is designated as "B" (moderate); and the case where abnormality is not generated to the last (40,000 sheets) is designated as "A" (good), respectively.

(v) Test Nos. 31 to 41 (Having a Fullerene Dispersed Entirely Therein):

FIG. 7 is a table to show the test results of an evaluation test which was carried out by using a sample having a fullerene dispersed in a cleaning blade.

Though C60 was used as the fullerene, its cluster size can be relatively easily adjusted. Concretely, toluene was mixed with an associated material of C60 in a concentration of 0.1%, with which is then mixed ethanol. The average cluster size of the fullerene can be controlled by its mixing ratio. Thereafter, the associated material of the fullerene is extracted from the toluene/ethanol solution and dispersed in a polyurethane rubber in the same manner as in the carbon nano tube, thereby preparing a cleaning blade. The results of FIG. 7 are the results in the case where the average cluster size is about 50 nm. The test method is the same as in Test Nos. 1 to 22.

Incidentally, the cluster size of the fullerene was measured by using a laser diffraction type particle size distribution analyzer (LA-950, manufactured by Horiba, Ltd.). With respect to the measurement method, a measurement sample is dispersed in ion exchanged water and thrown into a cell. A volume average particle size of every measured channel is accumulated from a small-particle size side. A particle size at which the accumulation reached 50% was defined as the volume average particle size.

On review of the test results as shown in FIG. 7, it is noted that the tendency is exactly the same as in the case where a carbon nano tube is dispersed. However, it is noted that both the shaving amount and the surface roughness are slightly lower than those in the case of dispersing a carbon nano tube. That is, with respect to an effect for making the surface of the photoreceptor uniform and shaving it very slightly, it is noted that the fullerene is more adaptive than the carbon nano tube.

Furthermore, with respect to the problems on the blade turning-up and the image, it is noted that the prolongation of life can be explicitly achieved in a region where the edge angle is 100° as compared with the case of dispersing a carbon nano tube.

(vi) Test Nos. 51 to 57 (with a Varied Particle Size of Fullerene):

FIG. 8 is a table to show the test results of an evaluation test which was carried out by using a sample with a varied cluster size of a fullerene to be dispersed entirely over a cleaning blade.

The adjustment of the cluster size of a fullerene was carried out by varying the amount of ethanol in the foregoing method. Furthermore, the edge angle of the blade was fixed at 80°, and the dispersion amount in the polyurethane rubber was set up at 20%, thereby preparing a blade. The test method is the same as in Test Nos. 1 to 22.

According to the test results as shown in FIG. 8, it is noted that while the larger the average cluster size, the large the average shaving amount of the photoreceptor, with respect to the surface roughness, the surface becomes rough in any case where the cluster size is too small or too large. In the test results, in the case where the cluster size was 3 nm, nevertheless the average shaving amount was small, the surface roughness became rough, cleaning failure was generated prior to reaching 35,000 sheets, and the observation of the photoreceptor revealed partial filming. Furthermore, when cluster size was 500 nm, not only the average shaving amount was large, but also the surface roughness was rough, and prior to reaching 35,000 sheets, cleaning failure and filming were similarly generated.

On the other hand, in the range of the cluster size of from 5 to 300 nm, the surface roughness was stable in a low value level, and after printing on 40,000 sheets, a problem was not generated on the image.

Furthermore, Test No. 57 shows the result in the case of using C70 as the fullerene in place of C60. In this way, the result which may be said to be exactly the same as in C60 is obtained, and it is noted that both C60 and C70 can be used in the same way.

(vii) Test Nos. 61 to 64 (with a Varied Material of Photoreceptor):

FIG. 9 is a table to show the test results of an evaluation test which was carried out by using a blade as prepared by containing 20% of a fullerene (cluster size: 50 nm) and setting up the angle of the edge part at 80° and varying a material of the photoreceptor. The test method is the same as in Test Nos. 1 to 22.

According to the test results as shown in FIG. 9, in a sample in which the photoreceptor was made of α-Si (amorphous silicon) and a fullerene was contained in only the blade edge part (Test No. 62), while the shaving amount of the photoreceptor after printing on 10,000 sheets was substantially zero as 0.2 μm and the surface roughness (Rz) was very small as 0.3, turning-up of the blade was generated in the high-temperature and high-humidity circumstance. At this time, as a result of observation of the blade edge, the edge part was abraded, and the polyurethane rubber as the base material was exposed.

On the other hand, in Test No. 63 in which the fullerene was contained entirely over the blade, a good image could be printed even after printing on 40,000 sheets.

The shaving amount of the photoreceptor after printing on 40,000 sheets was overwhelmingly small as compared with a usual photoreceptor using OPC (organic photoconductor), and it is noted that filming can be prevented from occurring by the cleaning blade of the invention without substantially shaving the photoreceptor.

Furthermore, Test No. 64 is an example in which the test was carried out by using, as the organic photoreceptor, a photoreceptor having a chain polymerizable functional group-containing hole transport material as disclosed in JP 2005-173566 A. In a photoreceptor of this kind, the surface hardness is high so that a scratch is hardly formed, and a long life of the photoreceptor is attained. According to the test results, likewise the case of using the photoreceptor made of α-Si, filming can be prevented from occurring without substantially shaving the photoreceptor, and a problem is not generated at all even after printing on 40,000 sheets.

That is, in this way, by combining a highly durable photoreceptor having a hard surface with the present embodiment, filming can be prevented from occurring without substantially shaving the photoreceptor over a long period of time. Thus, it is noted that such a combination is very advantageous for realizing high durability of an image forming apparatus.

(viii) Test Nos. 71 to 73 (Cleaning of Conveyor Belt):

FIG. 10 is a table to show the test results of an evaluation test which was carried out by using a cleaning blade according to the invention against a conveyor belt.

Likewise Test No. 35, a cleaning blade as prepared by containing 20% of a fullerene having a cluster size of 50 nm in a polyurethane rubber and setting up a blade edge angle at 80° was used as the blade. With respect to the test method, a so-called transfer belt type also functioning as a paper conveyance measure (the same type as the conveyor belt 16 as illustrated in FIG. 1) was used, and a solid toner was transferred every printing on 1,000 sheets, thereby confirming whether or not cleaning could be achieved. As to the belt material, a polyimide having a thickness of 100 μm was used.

The evaluation method was basically the same as in Test Nos. 1 to 22. However, the shaving amount and the surface roughness were not measured, and whether or not cleaning failure or blade turning-up was generated was tested.

According to the test results as shown in FIG. 10, in a conventional blade not containing a fullerene, turning-up of the blade was generated in the high-temperature and high-humidity circumstance after completion of the printing operation on 10,000 sheets (Test No. 71). Subsequently, in the case of coating a resin having a fullerene dispersed therein in only a blade edge part, cleaning failure was generated after printing on 25,000 sheets (Test No. 72). At this time, the blade edge was abraded, and the polyurethane rubber as the base material was exposed.

On the other hand, in Test No. 73 using a cleaning blade according to the present embodiment, cleaning failure was not generated even after printing on 40,000 sheets so that good cleaning could be kept.

As described previously, in accordance with the cleaning apparatus 30 according to the present embodiment and the image forming apparatus 1 provided with that cleaning apparatus 30, it is possible to make high durability and good cleaning performance compatible with each other.

Incidentally, it should not be construed that the invention is limited to the foregoing embodiments as they are, but configuration elements can be modified and materialized in the enforcement stage within the range where the gist of the invention is not deviated. Furthermore, by a proper combination of plural configuration elements as disclosed in the foregoing embodiments, a variety of inventions can be formed. For example, some configuration elements may be eliminated from the whole of the configuration elements as shown in the embodiments. In addition, configuration elements over different embodiments may be properly combined.

What is claimed is:

1. A cleaning apparatus provided with a cleaning blade which removes a developer remaining on a surface of an image carrier, wherein the cleaning blade is made of a resinous matrix dispersion in which at least one of a fullerene and a carbon nano tube is dispersed, and at least one of the fullerene and the carbon nano tube is mixed and dispersed in a total amount of from 0.02 to 20 parts by weight based on 100 parts by weight of the resinous matrix in the cleaning blade.

2. The cleaning apparatus according to claim 1, wherein the cleaning blade is formed such that an edge angle of a cleaning edge coming into contact with the surface of the image carrier is not more than 90°.

3. The cleaning apparatus according to claim 1, wherein the cleaning blade is formed such that an edge angle of a cleaning edge coming into contact with the surface of the image carrier is not more than 80°.

4. The cleaning apparatus according to claim 2, wherein at least one of the fullerene and the carbon nano tube is mixed and dispersed in a total amount of from 10 to 20 parts by weight based on 100 parts by weight of the resinous matrix in the cleaning blade.

5. The cleaning apparatus according to claim 2, wherein the developer to be removed by the cleaning blade has a volume average particles size of not more than 6 μm, a shape factor SF-1 of not more than 140 and a shape factor SF-2 of not more than 130.

6. The cleaning apparatus according to claim 2, wherein the cleaning blade has a hardness of 70° or more.

7. The cleaning apparatus according to claim 2, wherein the fullerene to be dispersed in the resinous matrix contains at least one of C60 and C70.

8. The cleaning apparatus according to claim 2, wherein the fullerene to be dispersed in the resinous matrix has an average particle size of from 5 to 300 nm in terms of its cluster.

9. The cleaning apparatus according to claim 2, wherein the image carrier is a photoreceptor configured of a material containing amorphous silicon.

10. The cleaning apparatus according to claim 2, wherein the image carrier is an organic photoreceptor having a hole transport material containing a chain polymerizable functional group.

11. An image forming apparatus comprising:

a photoreceptor;

an exposure apparatus which forms an electrostatic latent image on a surface of the photoreceptor;

a development apparatus which develops the electrostatic latent image with a developer; and a cleaning blade which removes the developer remaining on the surface of the photoreceptor, wherein the cleaning blade is made of a resinous matrix in which at least one of a fullerene and a carbon nano tube is dispersed, and at least one of the fullerene and the carbon nano tube is mixed and dispersed in a total amount of from 0.02 to 20 parts by weight based on 100 parts by weight of the resinous matrix in the cleaning blade.

12. The image forming apparatus according to claim 11, wherein the cleaning blade is formed such that an edge angle of a cleaning edge coming into contact with the surface of the photoreceptor is not more than 90°.

13. The image forming apparatus according to claim 12, wherein at least one of the photoreceptor and the development apparatus is accommodated in a process cartridge which is configured such that it is detachable from the image forming apparatus.

14. The image forming apparatus according to claim 12, wherein at least one of the fullerene and the carbon nano tube is mixed and dispersed in a total amount of from 10 to 20 parts by weight based on 100 parts by weight of the resinous matrix in the cleaning blade.

15. The image forming apparatus according to claim 12, wherein the developer to be removed by the cleaning blade has a volume average particles size of not more than 6 μm, a shape factor SF-1 of not more than 140 and a shape factor SF-2 of not more than 130.

16. The image forming apparatus according to claim 12, wherein the cleaning blade has a hardness of 70° or more.

17. The image forming apparatus according to claim 12, wherein the fullerene to be dispersed in the resinous matrix contains at least one of C60 and C70.

18. The image forming apparatus according to claim 12, wherein the fullerene to be dispersed in the resinous matrix has an average particle size of from 5 to 300 nm in terms of its cluster.

19. The image forming apparatus according to claim 12, wherein the photoreceptor is a photoreceptor configured of a material containing amorphous silicon.

20. The image forming apparatus according to claim 12, wherein the photoreceptor is an organic photoreceptor having a hole transport material containing a chain polymerizable functional group.

* * * * *